US006775924B2

(12) United States Patent
Bruntz et al.

(10) Patent No.: US 6,775,924 B2
(45) Date of Patent: Aug. 17, 2004

(54) HEATER CONTROL SYSTEM FOR A CLOTHES DRYER

(75) Inventors: Jordan S. Bruntz, Baxter, IA (US); Joel L. Herr, Newton, IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/152,013

(22) Filed: May 22, 2002

(65) Prior Publication Data

US 2003/0217481 A1 Nov. 27, 2003

(51) Int. Cl.[7] ..... F26B 19/00
(52) U.S. Cl. ..... 34/543; 219/482
(58) Field of Search ..... 34/543, 524, 549, 34/553; 219/482, 483, 485

(56) References Cited

U.S. PATENT DOCUMENTS

| | | | | |
|---|---|---|---|---|
| 2,851,790 A | | 9/1958 | Worst | |
| 2,919,493 A | | 1/1960 | Candor | |
| 3,286,361 A | | 11/1966 | Cobb et al. | |
| 3,409,994 A | | 11/1968 | Menk | |
| 3,508,340 A | | 4/1970 | Kombol | |
| 3,571,941 A | | 3/1971 | Garfield et al. | |
| 3,612,500 A | | 10/1971 | Cramer et al. | |
| 3,874,089 A | * | 4/1975 | Offutt | 34/45 |
| 4,112,588 A | * | 9/1978 | Marcade | 34/45 |
| 4,586,267 A | | 5/1986 | Sussman | |
| 4,636,619 A | * | 1/1987 | Sugimori | 219/497 |
| 4,827,627 A | | 5/1989 | Cardoso | |
| 4,842,192 A | | 6/1989 | Range et al. | |
| 5,443,541 A | | 8/1995 | St. Louis | |
| 5,978,995 A | * | 11/1999 | Bruntz et al. | 8/158 |
| 5,986,243 A | * | 11/1999 | Campf | 219/529 |
| 6,047,486 A | | 4/2000 | Reck et al. | |
| 6,064,043 A | * | 5/2000 | Livers, Jr. et al. | 219/492 |
| 6,199,300 B1 | * | 3/2001 | Heater et al. | 34/446 |
| 6,446,357 B2 | * | 9/2002 | Woerdehoff et al. | 34/491 |

* cited by examiner

*Primary Examiner*—Henry Bennett
*Assistant Examiner*—Camtu Nguyen
(74) *Attorney, Agent, or Firm*—Diederiks & Whitelaw, PLC

(57) ABSTRACT

A clothes dryer is provided with control elements which enable a user to set both a drying temperature and the amount of power sent to a main heating element of the dryer during a dryer cycle. In accordance with the most preferred form of the invention, an infinitely variable power supply controller is used to selectively establish the maximum power provided to the main heating element during the dryer cycle. The controller preferably is adjusted by a slider switch mounted on a control panel of the dryer. The switch is preferably provided with indicators to indicate the established power level.

11 Claims, 3 Drawing Sheets

HEATER CONTROL SYSTEM FOR A CLOTHES DRYER

BACKGROUND OF THE INVENTION

1. Field of the Invention

The present invention relates to a heater control system for a clothes dryer and, more particularly, to a clothes dryer control system having a circuit for controlling the operation of a heater of the dryer so that the power supplied to the heater may be regulated by an operator in an infinitely variable manner.

2. Discussion of the Prior Art

It is well known in the art to provide a clothes dryer with a mechanism to control the amount of heat supplied during a drying process. For example, a clothes dryer having a simple time-dry control allows a user to place wet articles inside the dryer and to select both a duration and a temperature setting for the drying process. In such a process, drying simply continues until the set time expires. Typically, in such an operation, the dryer will initially set its electrical heating element to a full power of approximately 5,000 watts. The temperature within the dryer will then rise until it reaches a preset maximum. Thereafter, the dryer will enter a no power mode during which the heating element will be set to zero power. In general, the no power mode has been employed to avoid overheating the articles of clothing. The dryer will then alternate between full power and no power modes until the set time has expired.

In such an operation, the user has no control over what preset maximum power will be provided to the heater of the dryer. Further the amount of heat provided in the no power mode, namely zero power, is also not affected by either the user or the control circuit in prior art devices. This is particularly problematic for delicate clothing which can be easily damaged by high temperatures. To address this potential problem regarding delicate clothing, dryers typically allow for a fluff cycle during which time the heating element is not activated at all. Of course, without any heating, drying times can be excessively long.

It is also well known in the art to provide a clothes dryer with a sensor that automatically controls the drying operation. Essentially, when a sensor dry mode is selected, the user places wet articles inside the dryer drum and selects a desired final dryness level. Instead of forcing the user to guess as to how long the process should take, the machine stops when the desired dryness level is reached. For this purpose, the machine includes at least one moisture sensor for detecting the level of moisture in the articles. The machine simply operates until the moisture sensor detects the final desired dryness level selected. By terminating the process upon achieving the desired final dryness level, there is no need to re-start the drying process to finish incomplete drying. In addition, extra energy is not expended to dry the articles beyond the desired dryness level.

Even with the sensor-dry mode, a typical prior art dryer will have its electrical heating element initially set to full power, again approximately 5,000 W. Once again the temperature within the dryer will then rise until it reaches a preset maximum. The dryer will then enter a no power mode during which the heating element will be set to zero power. In a manner similar to the time-dry mode, the dryer will cycle between the heating mode and no power mode until the moisture sensor detects the final desired dryness level selected. Even with the use of a moisture sensor, articles of clothing placed within the drying machine are still subject to a temperature which varies from a high-temperature that may damage some types of clothing, to a low-temperature which is inefficient in that it will not properly dry the clothing in a reasonable amount of time.

Other known dryer arrangements work in a somewhat different manner. For example, U.S. Pat. No. 3,612,500 teaches controlling a first source of heat to establish a high output level for an initial portion of a drying cycle and a second source of heat to establish a lower output level during a subsequent portion of the drying cycle. Specifically, two heater elements are provided, rated at 3,100 and 2,500 watts respectively. During an initial portion of the drying cycle, both heaters are on. However, after the temperature in the drum reaches 160° F., both heaters are turned off and, for the rest of the cycle, only one of the heaters is turned on and off, with a thermostat being used to control the dryer temperature. Even with this modification, the lower power level for the heater equals zero and the upper power level can only be set by the controller to either 5,600 watts or 2,500 watts.

In a similar manner, U.S. Pat. No. 3,508,340 discloses a dryer that provides heating at two power levels. During a first phase of heating, a high power of 4,400 watts is achieved by applying 240 volts to a heating element, while a low power of 1,100 watts is achieved later in the cycle by providing 120 volts to the heating element. Even with this teaching, the power supplied, while the thermostat is cycling, is zero and the upper power can only be set by the controller to either 4,400 watts or 1,100 watts.

Finally, U.S. Pat. No. 2,851,790 also discloses a temperature control system for a dryer. This patent teaches using a variable resistor in series with a bias heater so as to allow for variable adjustment of the output of the bias heater. The bias heater is used to heat a temperature control thermostat so that the thermostat will trip at a lower temperature. Regardless, the main heater still operates at either a high power level or at a no power level.

Based on the above, there exists a need in the art to provide a control system for a clothes dryer which allows for adjustment of the amount of power sent to a heating element of the dryer. In addition, it would be beneficial for such an adjustment to be infinitely variable from zero to a maximum value.

SUMMARY OF THE INVENTION

The present invention is particularly directed to a control system for a clothes dryer including a timer, a temperature sensor, and a circuit which is able to set the amount of power sent to a main heating element of the dryer during various cycles of operation. In accordance with the invention, the user, by means of an infinitely variable power supply switch, may control the maximum power provided to the main heating element within the dryer. The switch takes the form of a slider switch mounted on a control panel of the dryer. The switch is preferably provided with indicators mounted to show how much power is being supplied to the heating element. In general, the slider switch can be used to alter the rate of the increasing temperature change within the dryer or the maximum amount of power the main heating element could use at a given position. In accordance with the most preferred form of the invention, the switch allows for the heating element to be supplied with a maximum amount of power that varies from 0 to 5,150 watts. The overall control circuit preferably employs a triac and a variable resister to achieve the infinitely variable power supplied.

Additional objects, features and advantages of the invention will become more readily apparent from the following detailed description of preferred embodiments thereof, when taken in conjunction with drawings wherein like reference numerals refer to corresponding parts in the several views.

DETAILED DESCRIPTION OF THE PREFERRED EMBODIMENT

Figure 1:
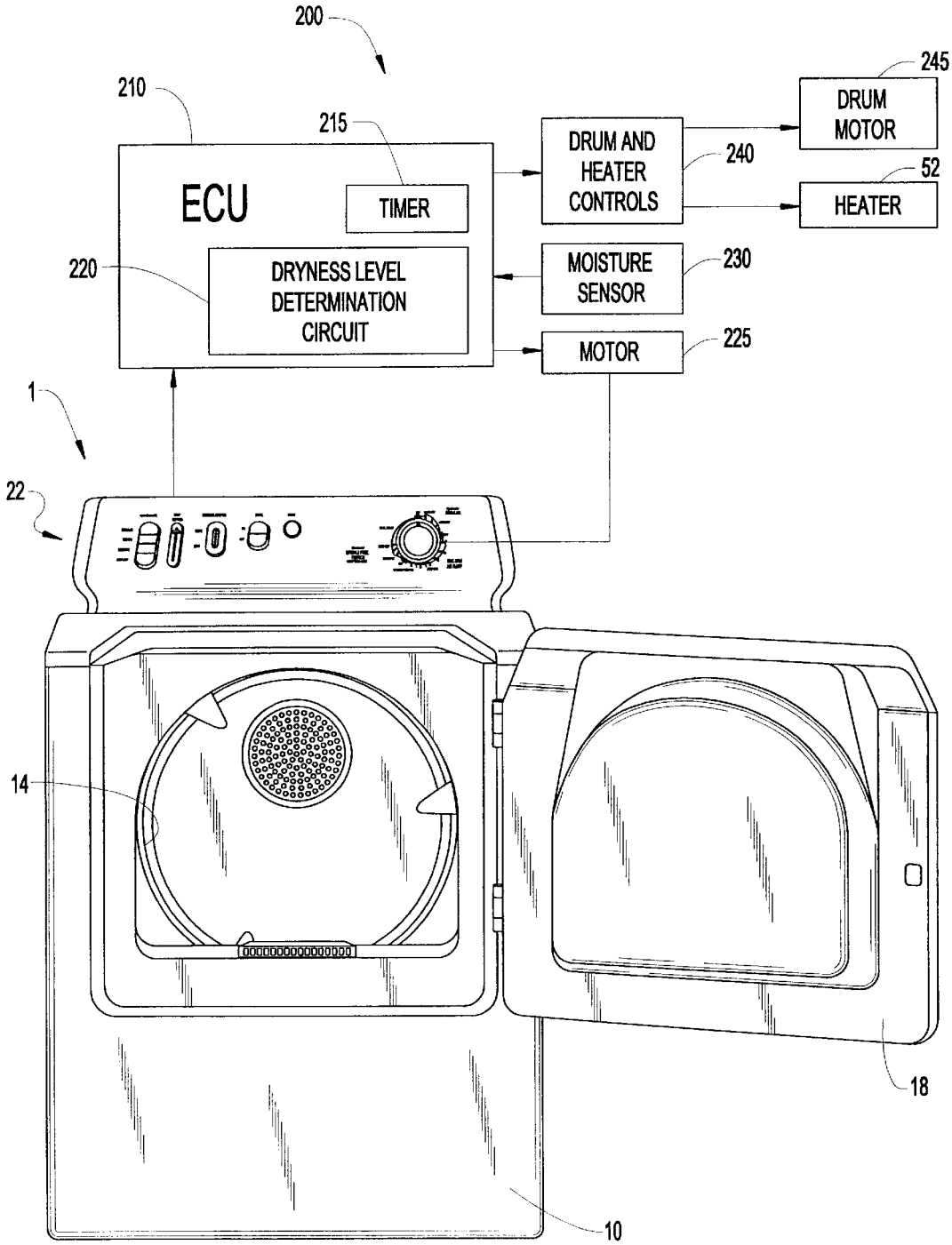
FIG. 1 is a front view of a clothes dryer incorporating a power level control system in accordance with the invention.

A clothes dryer 1 of the present invention is shown in FIG. 1 and generally includes an outer cabinet 10 having a frontal opening leading to a rotatable drum 14 and a door 18 for closing the opening. Disposed on the upper surface of outer cabinet 10 is a control panel 22 for establishing a desired operational sequence for programming clothes dryer 1 of the invention.

Figure 2:
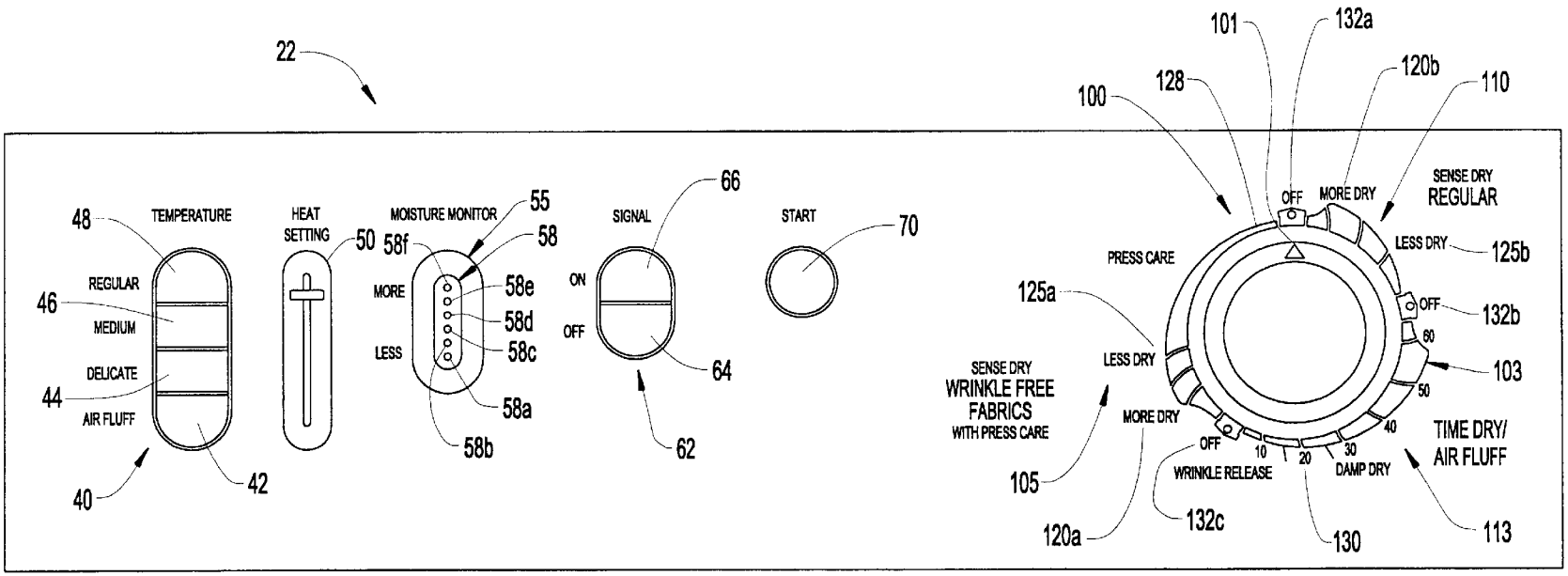
FIG. 2 is a plan view of a control panel provided on the clothes dryer of FIG. 1.

FIG. 2 depicts a close-up view of control panel 22 which includes a plurality of buttons and other elements for setting parameters of a desired drying operation for clothes dryer 1. Although control panel 22 is described below in a specific arrangement, it should be understood that the particular arrangement is only exemplary, as a wide range of layouts would suffice. In any event, shown on the left side of control panel 22 is a temperature selector 40 which includes buttons for determining the maximum temperature achievable in drum 14 of clothes dryer 1. In the most preferred embodiment, temperature selector 40 includes an air fluff button 42, a delicate button 44, a medium button 46 and a regular button 48.

Next to temperature selector 40 is an infinitely variable control member which preferably takes the form of a slider switch 50. In accordance with the invention, slider switch 50 sets the maximum amount of power that will be sent to a main heating element which is shown schematically at 52 in FIG. 3. In this manner, the consumer may set the power to an infinite number of settings, preferably from zero to 5,150 W. Slider switch 50 could readily be provided with some type of indicia indicating different temperature or power levels. A typical slider switch construction is described in U.S. Pat. No. 5,978,995 which is hereby incorporated by reference in its entirety.

Next to slider switch 50 is provided a moisture monitor 55 for displaying the current moisture state of articles contained within clothes dryer 1. Moisture monitor 55 is shown as including a set of LED's 58 for indicating specific moisture levels. LED's 58 are shown vertically arranged, whereby the individual LED's 58*a–f* can be illuminated to indicate a current moisture level. For example, illuminating LED 58*a* alone can signify a low moisture level.

Proximate to moisture monitor 55 is a signal controller 62. Signal controller 62 is provided to selectively regulate the operation of a buzzer (not shown), and includes an "off" button 64 and an "on" button 66. The selection of the "on" button 66 causes the buzzer to sound upon completion of the drying operation, while selection of the "off" button 64 prevents the buzzer from sounding upon completion of the drying operation. Additionally, control panel 22 includes a start button 70 for commencing operation of clothes dryer 1.

Finally, control panel 22 includes a control dial 100 for programming clothes dryer 1. Disposed at the center of dial 100 is a location pointer 101 that indicates an established setting for dial 100. Annularly disposed about the periphery of dial 100 are indicia 103 that illustrate the various settings. Specifically, indicia 103 includes a first sensor dry zone 105, a second sensor dry zone 110, and a time-dry zone 113, each defining a portion of indicia 103 and designed to indicate the mode of dryer operation, i.e., a sensor dry mode or a time dry mode. Each of sensor dry zones 105 and 110 includes a respective more dry setting 120*a*, 120*b* and a respective less dry setting 125*a*, 125*b*, with continuous levels there between. First sensor dry zone 105 also includes a press care setting 128. Although not specifically labeled, a cool down sequence is provided at the end of the desired cycle in each zone 105, 110 and 113. A plurality of time increments 130 are defined by indicia 103 in time-dry zone 113. Finally, disposed between each of zones 105, 110 and 113 are off positions 132*a–c*. Depending on the operational state of clothes dryer 1, dial 100, and hence location pointer 101, will reference the appropriate indicia 103.

As indicated in FIG. 1, clothes dryer 1 also includes a control circuit generically indicated at 200. Specifically an ECU (electronic control unit) 210 is provided with a timer 215 and a dryness level determination circuit 220. A motor 225 is provided to drive timer 215 upon direction from ECU 210, or continuously within the time-dry zone 113. A moisture sensor 230 is provided as an additional input to ECU 210. Moisture sensor 230 may be any conventional construction known in the art, such as the moisture sensor described in U.S. Pat. No. 4,477,982 to Cotton, which is hereby incorporated in its entirety by reference. A series of drum and heater controls are collectively represented at 240 which, when directed by ECU 210, function to rotate drum 14 and regulate heating element 52 in response to a drying profile set through control panel 22 and the output from ECU 210.

Figure 3:
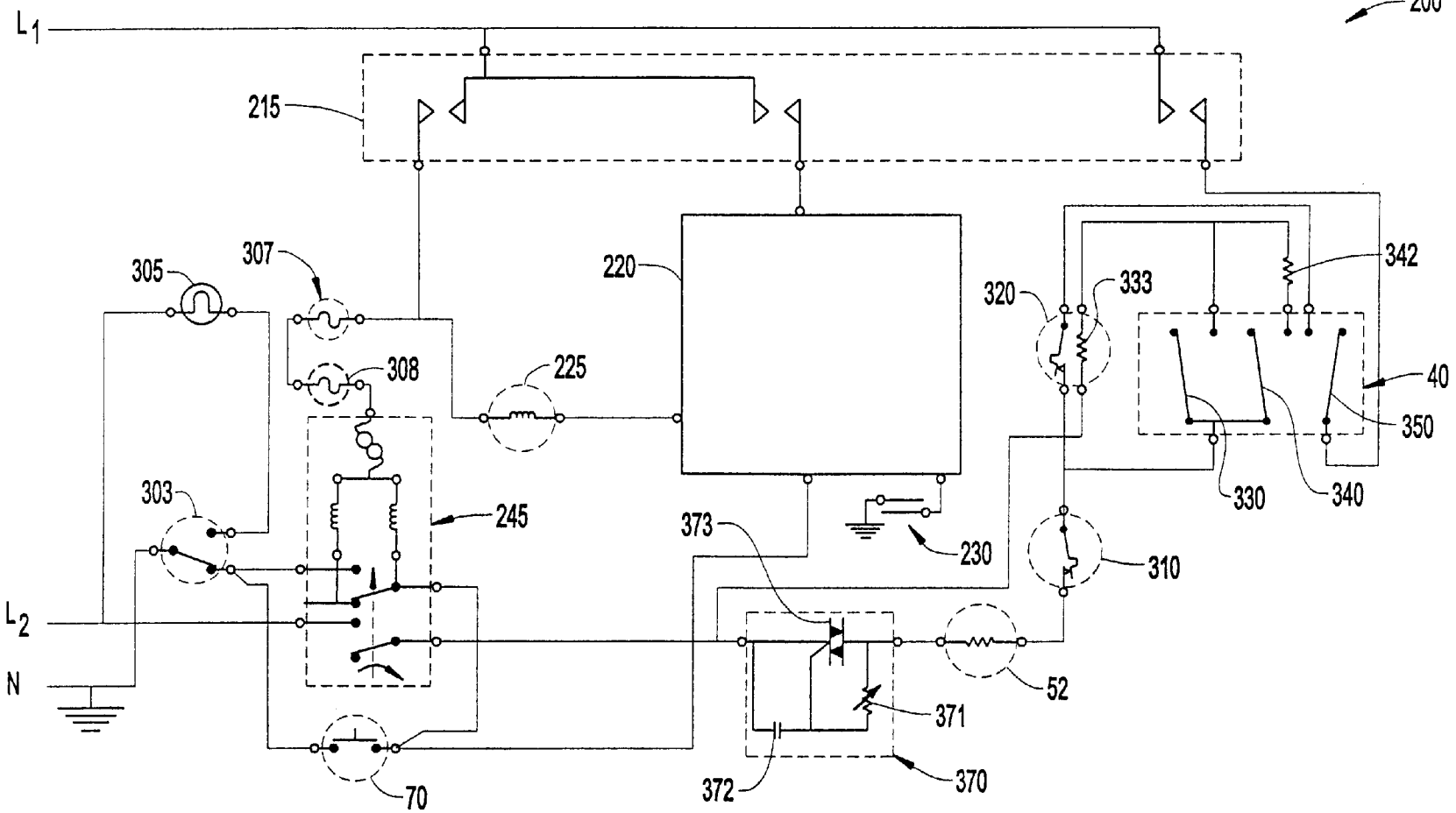
FIG. 3 is a control circuit diagram according to the preferred embodiment of the invention.

Turning now to FIG. 3 which shows a general electrical diagram for a preferred embodiment of the invention, the details of the electric control structure and operation will now be discussed. For purposes of this discussion, dryer 1 is connected to a household power supply, i.e., a typical household, three wire 240 volt supply wherein two wires provide 120 volts of electricity with potentials that are opposite from one another and a third wire is neutral or, in other words, connected to ground. As can be seen in the left-hand side of FIG. 3, a terminal block having terminals L1, L2 and neutral is provided. A 240 volt potential is therefore provided across terminals L1 and L2, while a 120 volt potential may be provided between either L1 and neutral or L2 and neutral.

As shown, control circuit 200 comprises a door operated switch 303 generally connected in series with N. Door switch 303 is designed to prevent operation of dryer 1 when door 18 is in the open position. Additionally, when door 18 is in the open position, door switch 303 will provide power to lamp 305 which will illuminate the inside of drum 14, thereby making it easier to load and unload clothing. Control circuit 200 also includes push-to-start button or switch 70, a drum drive motor 245, and timing device 215. A pair of fuses 307 and 308, dryness level control circuit 220, temperature selector 40, a high limit thermostat 310, main heater 52, and a cycling thermostat 320 complete the basic control circuit 200.

As stated above, when door switch 303 is in the open condition, power is delivered to interior lamp 305, but not to drive motor 245 or other portions of circuit 200. However, when door 18 is closed, switch 303 allows power to both drive motor 245 and push-to-start switch 70. When push-to-start switch 70 is pushed for a certain amount of time by an operator, power is then sent further along circuit 200 to dryness level determination circuit 220 and, in addition, to cycling thermostat 320. Dryness level determination circuit 220 and timer motor 225 generally operate as conventional in the art. Basically, the overall timer system includes timer motor 225 and a plurality of both movable and fixed contacts so that, as timer 215 cycles through various operations of dryer 1 according to a fixed schedule, different contacts are sequentially engaged or disengaged. As this is well known in the art, further details of timer motor 225 will not be described here. The two fuses 307 and 308 are placed between timer 215 and drive motor 245 as shown in the drawing. Fuses 307 and 308 are simply there for safety purposes and will, as well known in the art, disconnect power from drive motor 245 in overload conditions.

Turning now to temperature selector 40, as noted above, temperature selector 40 has four basic settings, i.e., regular, medium, delicate and air fluff. Basically, temperature selector 40 includes three internal switches, each having associated "on" and "off" positions. The first internal switch essentially constitutes a high bias switch 330 for cycling thermostat 320. When the high bias switch 330 is "on", it provides power to a biasing heater 333. Biasing heater 333 causes cycling thermostat 320 to trip at a relatively low set point or at least trip when the clothes in dryer 1 are at a relatively low temperature compared to when high bias switch 330 is in the "off" position. In the "off" position, high bias switch 330 provides no current to biasing heater 333.

The second internal switch is constituted by a low bias switch 340 for cycling thermostat 320. When low bias switch 340 is "on", it provides power to biasing heater 333 much like high bias switch 330. However low bias switch 340 sends current through a resistor 342 before the current reaches biasing heater 333. Therefore biasing heater 333 produces less heat through low bias switch 340 than when it is activated by high bias switch 330. When low bias switch 340 assumes an "on" position, biasing heater 333 causes cycling thermostat 320 to trip at a relatively low set point or at least trip when clothes in dryer 1 are at a relatively low temperature compared to when low bias switch 340 is in the "off" position. Of course thermostat 320 will trip at a relatively high set point through low bias switch 340 as compared to when it receives power from high bias switch 330. In the "off" position, low bias switch 340 provides no current to biasing heater 333.

The third internal switch is essentially a main heater switch 350. When main heater switch 350 is "on", power may travel from timer 215 to cycling thermostat 320 and then main heater 52. If main heater switch 350 is set to "off", no power will be sent to main heater 52.

In a regular setting, high bias switch 330 and low bias switch 340 are "off", and main heater switch 350 is "on". As a result, cycling thermostat 320 is not biased and trips at a high clothing temperature. Furthermore, power is supplied to main heater 52. In a medium setting, high bias switch 330 is "off", low bias switch 340 is "on", and main heater switch 350 is "on". As a result, power is supplied to main heater 52, while cycling thermostat 320 is biased slightly and trips at a medium clothes temperature. In a delicate setting, high bias switch 330 is "on", low bias switch 340 is "off", and main heater switch 350 is "on". As a result, cycling thermostat 320 is highly biased and trips at a low clothes temperature to protect the delicate clothes. Finally, in an air fluff setting, high bias switch 330 and low bias switch 340 are "off", and main heater switch 350 is "off". No power is supplied to biasing heater 333, but it is of no consequence because no power is supplied to main heater 52 and the clothes are just rotated in the drum 14 as air is blown through them.

As noted above, when the third internal switch, i.e., main heater switch 350, is in the "on" position, power is sent through cycling thermostat 320, high limit thermostat 310, and main heater 52. Hi-limit thermostat 310 normally stays in the closed position. Only in unusual or emergency conditions will the temperature get so high as to trip hi-limit thermostat 310. In this way, hi-limit thermostat 310 acts as a safety device and shuts down power to main heater 52 when the temperature in dryer 1 reaches unusually high temperatures. In the most preferred embodiment, main heater 52 is an electric resistance heater which will change the amount of heat produced as a function of the square of the voltage applied, as is well known in the art. However, other heater arrangements could be employed.

Located just beyond main heater 52 is an infinitely variable controller 370. Controller 370 may be of any known type that can provide an infinitely variable resistance, but preferably includes an infinitely variable resistor 371, which is controlled through slider switch 50, in series with a capacitor 372 and in parallel with a triac 373 as shown in FIG. 3. What is essential is that controller 370 is set up to limit the amount of current that may pass through heater 52 when cycling thermostat 320 and hi-limit thermostat 310 are in untripped or power supplying positions. Such an arrangement allows the operator to limit the maximum power used by dryer 1 through slider switch 50.

The operation of dryer 1 will now be described. After wet articles are placed within drum 14, a user selects a desired drying operation wherein temperature selector 40 is used to choose a desired operating temperature for clothes dryer 1. While selecting regular button 48 establishes the highest temperature setting and results in the fastest drying time, the "regular" setting may be too hot for some articles. Therefore, as discussed above, additional temperature levels such as medium, delicate, and air fluff are provided. The choice of which button is pushed in temperature selector 40 causes the appropriate internal switches 330, 340 and 350 to be set as described above. Before pressing start button 70 and beginning operation of clothes dryer 1, the user rotates dial 100 from a respective off setting 132*a–c* into time-dry zone 113, sensor dry zone 105, or second sensor dry zone 110. In the most preferred embodiment, the user also sets the maximum power that will be available to main heating element 52 for a given temperature setting through selector switch 40 by positioning infinitely variable switch 50 in a desired setting.

If dial 100 is rotated such that location pointer 101 is in time-dry zone 113, clothes dryer 1 will operate until the time indicated by a time increment 130 expires. ECU 210 directs motor 225 to rotate dial 100 at a relatively slow speed through a reduced duty cycle coinciding to time increments 130, and operates heater 52 based in part upon the temperature chosen via temperature selector 40 as described above. More specifically, as heater 52 raises the temperature of the clothes, thermostat 320 reaches an upper temperature limit and trips to turn heater 52 off. When the temperature hassufficiently cooled, the thermostat 320 switches again and returns the heater back to full power. Rotation of drum 14 continues until location pointer 101 reaches "off" setting 132*c*. If desired, moisture sensor 230 could be designed to operate during the time-dry mode to display to the user the current moisture level via moisture monitor 55, even though the sensor dry mode was not selected. In either sensor-dry mode, dryer 1 will run until the dryness level selected by rotating dial 100 is sensed by moisture sensor 230. The rest of the drying operation in either sensor-dry mode is the same as in the time dry mode.

With this overall control system, a consumer may vary the maximum power output of heater 52 anywhere between zero watts and 5,150 watts. The variable switch 50 allows selection of an infinite number of power levels between maximum and minimum values. In other words, while temperature selector 40 is used to set the maximum temperature achievable in drum 14 in a manner known in the art, slider switch 50 allows the user to actually adjust the rate at which the highest temperature can be achieved by controlling the power level of heater 52. Therefore, the actual power consumption of dryer 1 can be effectively controlled by the user. Testing performed on a six pound towel load with a 5.95 pound bone dry weight on a regular sense dry cycle and a regular temperature setting, the following data was collected by establishing the power level through switch 50 at 50, 75 and 100% setting.

Infinite Wattage Control Examples

| % of Maximum Wattage | Max. Inlet Air Temp. [F.] | Max. Exhaust Air Temp. [F.] | Max. Towel Temp. [F.] | Efficiency [lb/Kwh] | Rate [lb/min] | Run Time [min] |
|---|---|---|---|---|---|---|
| 100 | 271 | 162 | 170 | 1.52 | 0.114 | 54.1 |
| 75 | 257 | 158 | 160 | 1.73 | 0.107 | 55.4 |
| 50 | 219 | 141 | 140 | 1.64 | 0.10 | 61.2 |

Based on the above, it should be readily apparent that in a decreased maximum load temperature up to 30° F. resulted from a 50% decrease in wattage without a significant increase in run time. The operational efficiency also increased as the wattage/voltage level was decreased.

Although described with reference to a preferred embodiment of the invention, it should be readily understood that various changes and/or modifications can be made to the invention without departing from the spirit thereof. For example, although the most preferred embodiment of the invention employs slider switch 50 to provide for the infinite settings, other types of control elements could be readily employed, such as a rotary knob, distinct buttons, an overall touch screen, or the like, which may provide for infinite settings or just particular discrete settings. Also, although heater 52 is either on or off in accordance with the most preferred embodiment of the invention, heater 52 could be regulated between high and low levels during an entire drying operation, such as in a manner set forth in accordance with U.S. Patent Application entitled "Control System for Clothes Dryer Heater" filed on even date herewith and incorporated by reference. In general, the invention is only intended to be limited by the scope of the following claims.

We claim:

1. A clothes dryer comprising:

an outer cabinet shell;

a drum rotatably mounted within said outer cabinet shell, said drum being adapted to receive articles of clothing to be heated and dried within said drum;

a heater for heating the articles of clothing; and a control panel for inputting operational parameters for a drying cycle, with said operational parameters including a desired drying temperature and a variable power setting for the heater.

2. The clothes dryer according to claim 1, wherein the control panel includes a plurality of setting elements, one of said plurality of setting elements constituting a temperature selector for establishing the desired drying temperature and another one of said plurality of setting elements constituting an infinitely variable control member for establishing the variable power setting for the heater.

3. The clothes dryer according to claim 2, wherein the infinitely variable control member establishes an amount of power sent to the heater.

4. The clothes dryer according to claim 3, wherein the amount of power may be selectively varied between upper and lower wattage limits.

5. The clothes dryer according to claim 4, wherein the lower wattage limit is substantially zero.

6. The clothes dryer according to claim 5, wherein the upper wattage limit is greater than 5,000 watts.

7. The clothes dryer according to claim 2, wherein said infinitely variable control member constitutes a sliding switch.

8. A method of performing a drying operation on articles of clothing within a drum of a clothes dryer comprising:

setting a drying temperature for to drying operation;

adjusting a power setting for a heater of the clothes dryer, with the power setting representing the maximum allowable amount of power to be sent to the heater during the dryer operation; and performing the drying operation based on the set drying temperature and the power setting such that the amount of power sent to the heater is adjusted based on the set drying temperature up to the power setting.

9. The method of claim 8, further comprising: adjusting the power setting for the heater in an infinitely variable manner.

10. The method of claim 9, further comprising: manually positioning a control element provided on a control panel of the clothes dryer to establish the power setting.

11. The method of claim 10, wherein manually positioning the control element constitutes repositioning a slider switch.

* * * * *